US008516660B2

(12) United States Patent
Ku

(10) Patent No.: US 8,516,660 B2
(45) Date of Patent: Aug. 27, 2013

(54) CABLE TIE

(76) Inventor: Fei-Long Ku, Tainan (TW)

( * ) Notice: Subject to any disclaimer, the term of this patent is extended or adjusted under 35 U.S.C. 154(b) by 182 days.

(21) Appl. No.: 13/112,005

(22) Filed: May 20, 2011

(65) Prior Publication Data

US 2012/0291231 A1 Nov. 22, 2012

(51) Int. Cl.
*B65D 63/10* (2006.01)

(52) U.S. Cl.
USPC ..... 24/16 PB

(58) Field of Classification Search
USPC ..... 24/16 R, 16 PB, 17 A, 17 AP, 30.5 P, 24/171, 194
See application file for complete search history.

(56) References Cited

U.S. PATENT DOCUMENTS 3,300,825 A * 1/1967 Andreasen ..... 24/16 PB
3,494,002 A * 2/1970 Kabel ..... 24/16 PB
3,909,884 A * 10/1975 Weckesser ..... 24/16 PB
4,128,220 A * 12/1978 McNeel ..... 248/60
4,399,593 A * 8/1983 De Bradandere et al. ..... 24/25
4,688,302 A * 8/1987 Caveney et al. ..... 24/16 PB
6,230,369 B1 * 5/2001 Steadman ..... 24/16 PB
6,978,520 B2 * 12/2005 Falany ..... 24/171
7,882,599 B2 * 2/2011 Harrington ..... 24/17 AP
2009/0270923 A1 * 10/2009 Tormala et al. ..... 606/263

* cited by examiner

*Primary Examiner* — James Brittain
(74) *Attorney, Agent, or Firm* — St. Onge Steward Johnston & Reens LLC

(57) ABSTRACT

A cable tie is revealed. The cable tie includes a slot base with an insertion hole, a belt and at least one fastener. At least one surface of the insertion hole is a slanted surface. Locking teeth is arranged at a surface of the belt. The fastener is mounted into the insertion hole of the slot base correspondingly. The fastener includes a slanted surface corresponding to the slanted surface of the slot base, and projecting teeth corresponding to the locking teeth of the belt. When the belt is inserted through the insertion hole of the slot base to bind objects tightly, the fastener is mounted into the insertion hole so that the projecting teeth of the fastener are engaged with the locking teeth of the belt so as to lock and fix the belt. The cable tie can be used again once the belt is released from the fastener.

10 Claims, 14 Drawing Sheets

(B)

(A)

CABLE TIE

BACKGROUND OF THE INVENTION

1. Field of the Invention

The present invention relates to a cable tie, especially to a cable tie that is able to be released from a locked and secured state and used again.

2. Description of Related Art

Generally, refer to FIG. 1, a cable tie 1 used for fastening and bundling is an integrated piece, including a slot base 11 and a belt 12. The slot base 11 is mounted with an insertion hole 111 while at least one securing tooth 112 is arranged at an inner surface of the insertion hole 111. The belt 12 extends along one side of the slot base 11. A plurality of locking teeth 121 is disposed on one side of the belt 12.

Thereby when the belt 12 is passed through the insertion hole 111 of the slot base 11, the securing tooth 112 on the inner surface of the insertion hole 111 is engaged with one of the locking teeth 121 on the surface of the belt 2 so as to lock and locate the belt 2.

Although the cable tie can be used for bundling and fixing things, the belt is unable to be released from the slot base once the belt is passed through the insertion hole of the slot base and the securing tooth on the inner surface of the insertion hole is engaged with one of the locking teeth. That means the cable tie is unable to be released once it is tied around something. The only way to release the cable tie is to cut the cable tie by cutting tools. The broken cable tie can't be used again anymore. This leads to a waste and the cost users spent on the cable tie is increased.

Refer to FIG. 2, there is another kind of reusable cable tie available on the market. An integrated cable tie 2 consists of a slot base 21, an elastic locking/releasing part 22, and a belt 23. The slot base 21 having an insertion hole 211 is connected to the elastic locking/releasing part 22. Two ends of the elastic locking/releasing part 22 are a locking end 221 and a releasing end 222 respectively. The locking end 221 is disposed corresponding to the insertion hole 211. The slot base 21 is connected to a part of the elastic locking/releasing part 22 between the locking end 221 and the releasing end 222 so that the locking end 221 and the releasing end 222 act like a seesaw. As to the belt 23, it extends from one side of the slot base 21. A plurality of regular locking teeth 231 is set on one side of the belt 23, corresponding to the locking end 221.

In use, the belt 23 is passed through the insertion hole 211 of the slot base 21 and the locking end 221 of the elastic locking/releasing part 22 is locked with one of the locking teeth 231 of the belt 23. Thus the belt 23 is looped around things and locked. Once a user intends to get the belt 23 off, the releasing end 222 of the elastic locking/releasing part 22 is pressed. Then the locking end 221 of the elastic locking/releasing part 22 is released from the locking teeth 231 of the belt 23. Thus the cable tie can be used again.

However, there is room for improvement of this cable tie 2. While a force is applied to pull the looped cable tie 2, the elastic locking/releasing part 22 is also pulled by the force due to the locking end 221 of the elastic locking/releasing part 22 locked with the locking teeth 231 of the belt 23. Thus the elastic locking/releasing part 22 is rotated to another direction, as shown in the FIG. 3. Therefore the cable tie 2 can't hold the things securely. Moreover, the rotated elastic locking/releasing part 22 is easily to get broken or damaged.

SUMMARY OF THE INVENTION

Therefore it is a primary object of the present invention to provide a cable tie in which a belt can be removed from an insertion hole after the belt being passed through the insertion hole and projecting teeth of a fastener engaged with locking teeth of the belt. Thus the belt is drawn out of the insertion hole and used for binding and fastening things again. Moreover, the more the looped cable tie is pulled, the tighter the cable tie wrapped around the object. The cable tie allows objects to be fastened more securely.

In order to achieve the above objects, a cable tie of the present invention includes a slot base disposed with at least one insertion hole, a belt and at least one fastener. At least one surface of the insertion hole is a slanted surface. A plurality of locking teeth is arranged at a surface on one side of the belt. The fastener is mounted into the insertion hole of the slot base. The fastener consists of a slanted surface corresponding to the slanted surface of the insertion hole and a plurality of projecting teeth corresponding to the locking teeth of the belt. In use, a free end of the belt is passed through the insertion hole of the slot base to bind objects and the fastener is mounted into the insertion hole of the slot base. Thus the projecting teeth of the fastener are engaged with the locking teeth of the belt correspondingly and the slanted surface of the insertion hole is in contact with the slanted surface of the fastener. Therefore, the belt is locked and fastened securely. The more the looped belt is pulled, the tighter the locking between the fastener and the belt and the objects are held tightly. If a free end of the belt is drawn out, the fastener is not against the belt anymore and the cable tie is released. The cable tie can be used again.

Furthermore, the slot base of the cable tie can include two insertion holes and each insertion hole is mounted with a corresponding fastener.

The slot base can be disposed with a locking slot part and a releasing slot part, adjacent to each other while the fastener is disposed with a clamping part. By the clamping part of the fastener mounted in the locking slot part or the releasing slot part, the belt is locked by the fastener or the belt is released from the fastener.

A central part of the fastener is hollow so that there is a certain space allowing the two sides of the fastener to have elastic deformation. This helps the clamping part of the fastener to be mounted into or removed from the locking slot part or the releasing slot part smoothly.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
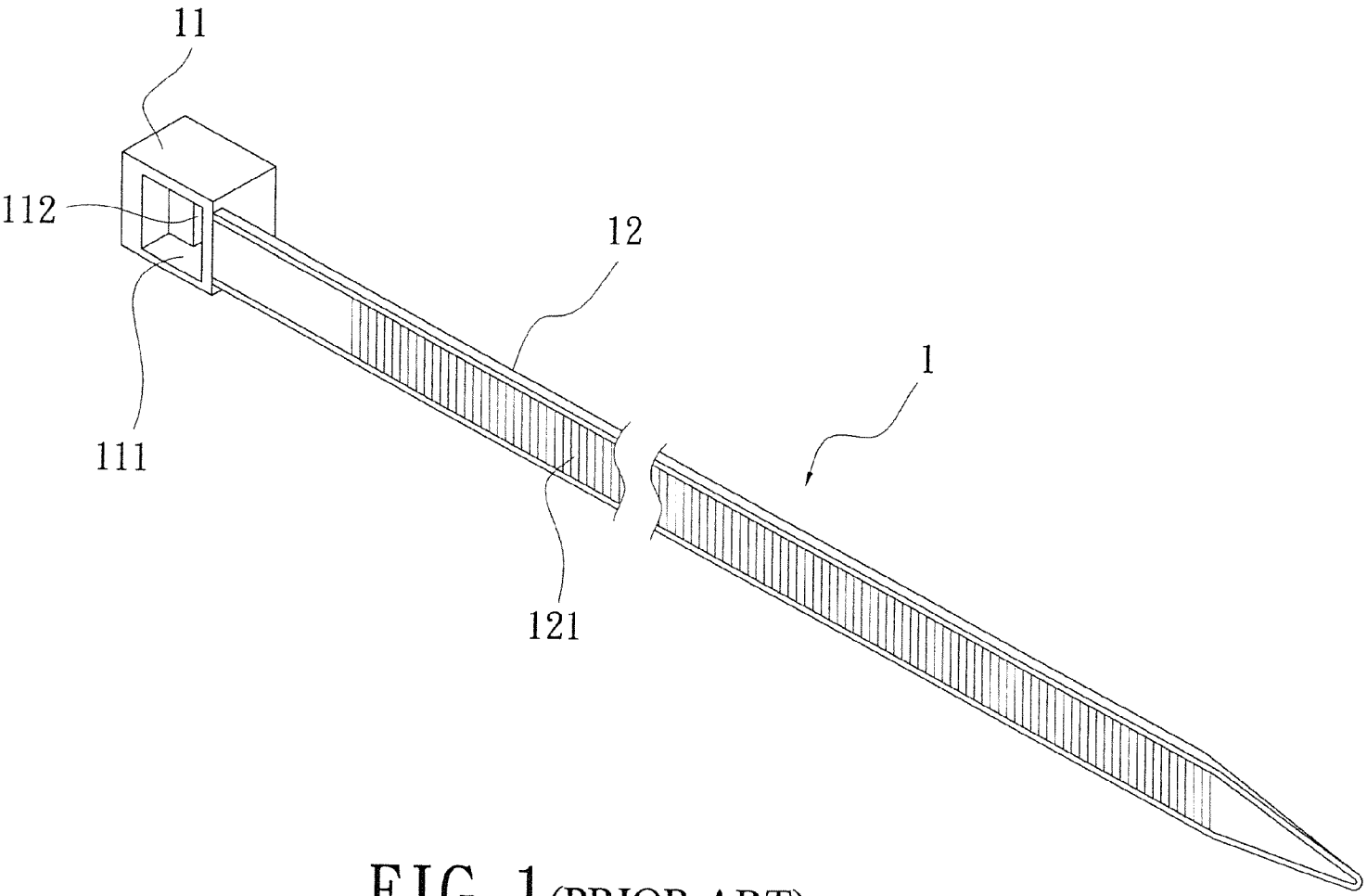
FIG. 1 (PRIOR ART)
FIG. 1 is a cable tie of a prior part.
Figure 2:
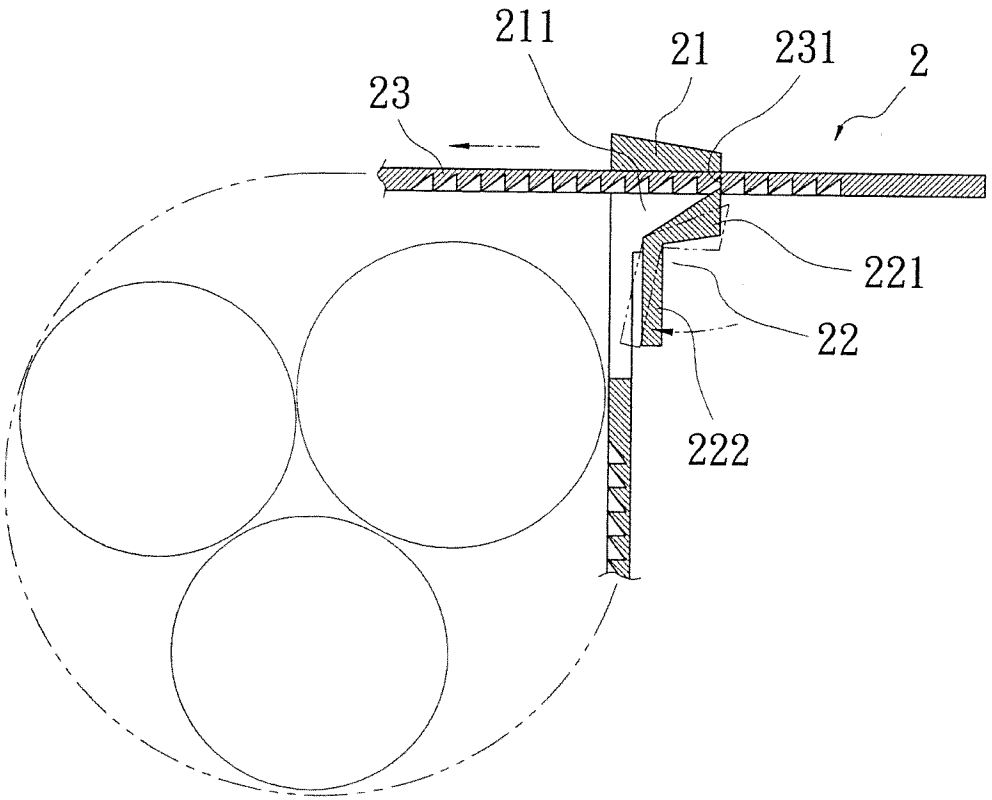
FIG. 2(PRIOR ART)
FIG. 2 is a partial side view of a prior art looped around things.
Figure 3:
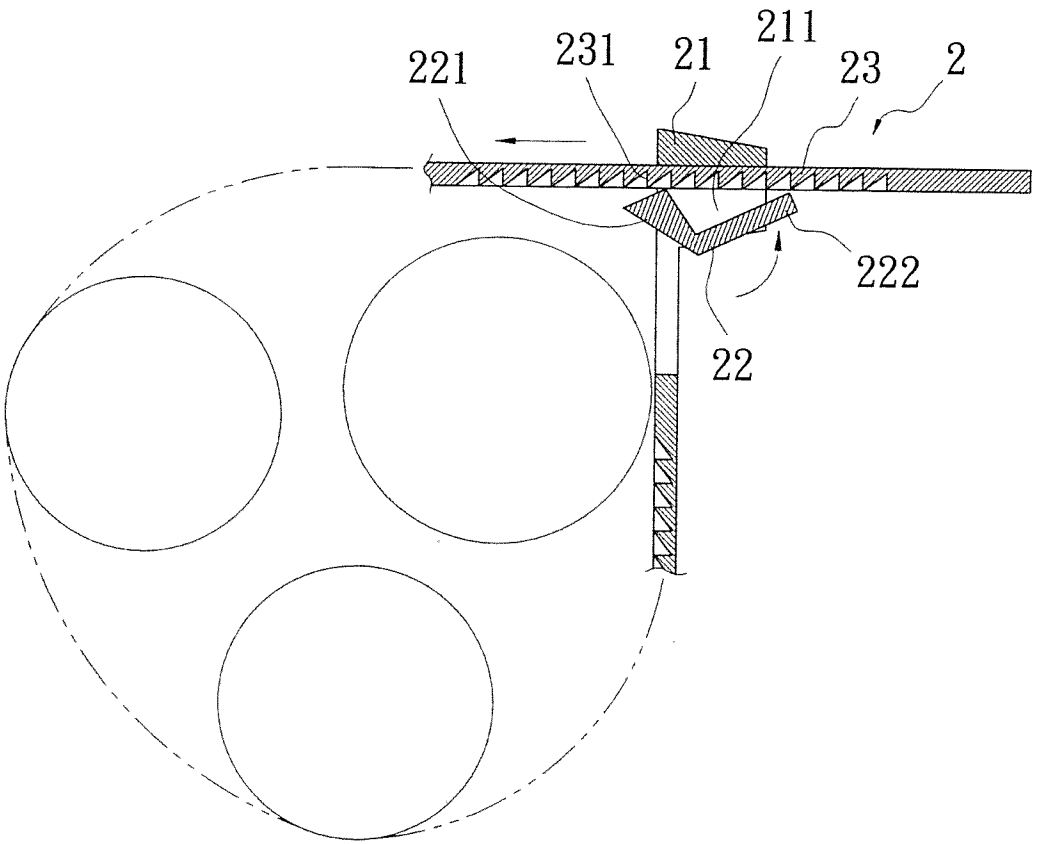
FIG. 3(PRIOR ART)
FIG. 3 is a schematic drawing showing rotation of an elastic locking/releasing part of a cable tie according to a prior art.
Figure 4:
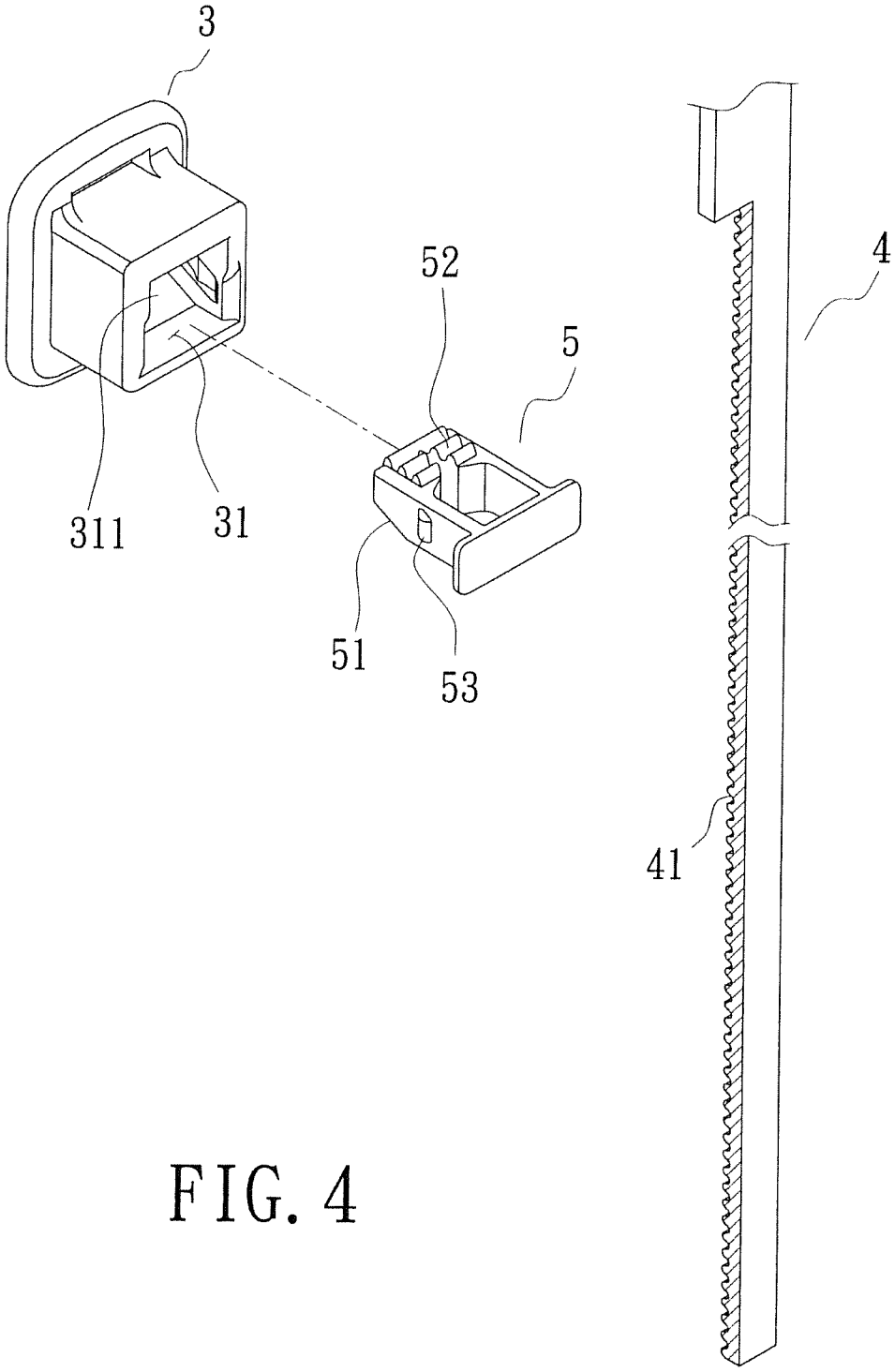
FIG. 4 is a perspective view of an embodiment according to the present invention.

Refer to FIG. 4, a cable tie of the present invention includes a slot base 3, a belt 4 and a fastener 5. The slot base 3 is disposed with an insertion hole 31. At least one surface of the insertion hole 31 is a slanted surface 311. A plurality of locking teeth 41 is arranged at a surface on one side of the belt 4. The fastener 5 is mounted into the insertion hole 31 of the slot base 3 correspondingly. The fastener 5 includes a slanted surface 51 arranged corresponding to the slanted surface 311 of the slot base 3, and a plurality of projecting teeth 52 corresponding to the locking teeth 41 of the belt 4. The projecting teeth 52 are arranged on a surface of the fastener 5.

Figure 5:
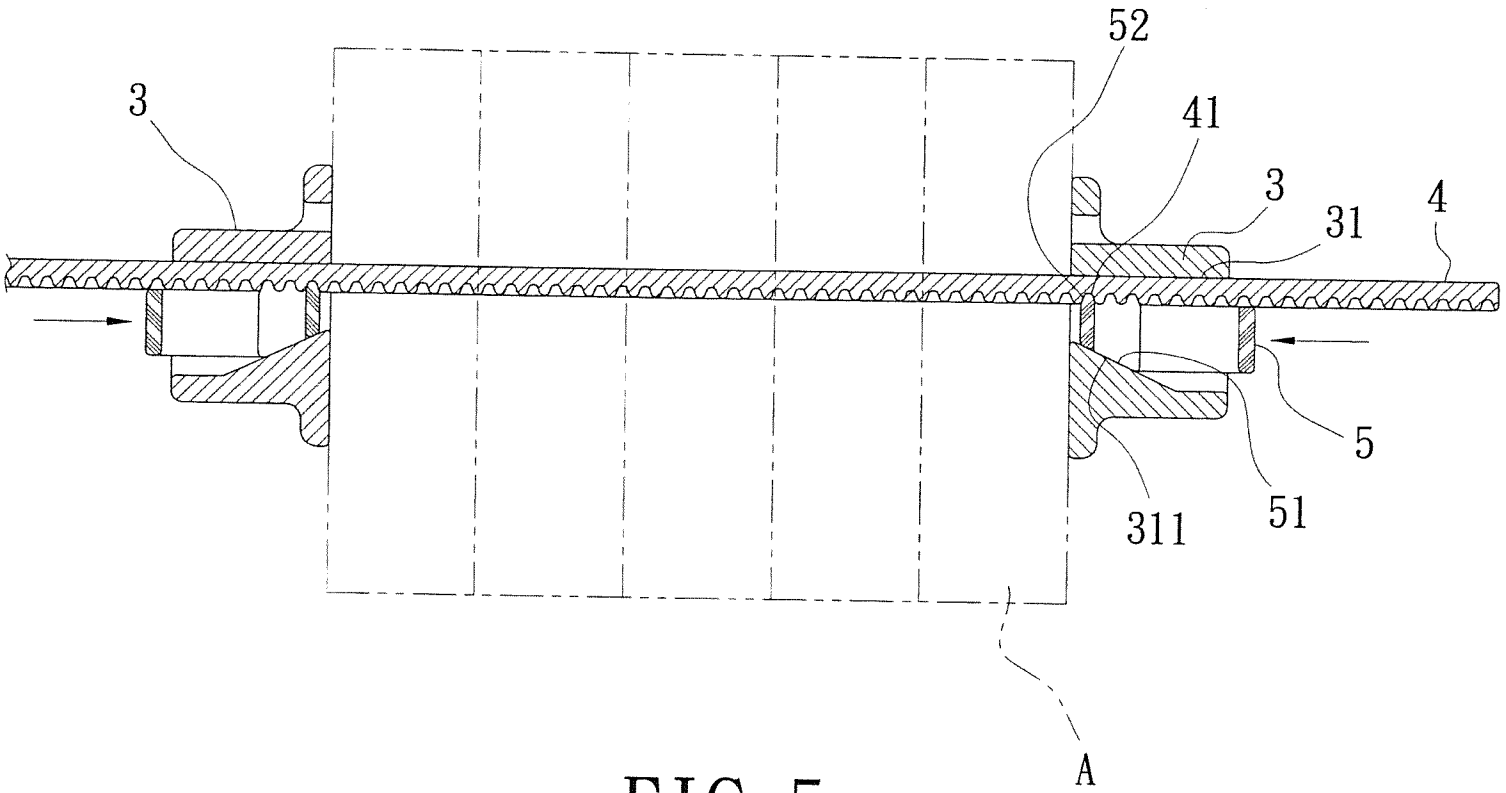
FIG. 5 is a schematic drawing showing the embodiment in FIG. 4 in a locked state according to the present invention.

As shown in FIG. 5, thereby after the belt 4 being passed through the insertion hole 31 of the slot base 3 and fastening the at least one object A, the fastener 5 is mounted into the insertion hole 31 of the slot base 3 and the projecting teeth 52 of the fastener 5 are engaged with the locking teeth 41 of the belt 4 so as to lock the belt 4.

Due to the slanted surface 311 on the insertion hole 31 of the slot base 3, one end of the insertion hole 31 is a small hole while the other end thereof is a large hole. The fastener 5 also includes the slanted surface 51 corresponding to the slanted surface 311 on the insertion hole 31. Thus when a free end of the belt 4 is inserted through the insertion hole 31 of the slot base 3, the more the belt 4 moves toward the end of the insertion hole 31 with the small hole, the tighter the projecting teeth 52 of the fastener 5 is against the locking teeth 41 of the belt 4. The more pull put on the belt 4 that holds the object A, the tighter the fastener 5 locked with the belt 4. The object A is held securely and certainly, not falling out.

Once a user wants to release the projecting teeth 52 of the fastener 5 from the locking teeth 41 of the belt 4, the belt 4 is drawn out from one end of the insertion hole 31 with the large hole. Together with the belt 4, the fastener 5 is also pulled and moved toward the large hole end of the insertion hole 31 of the slot base 3. Thus the projecting teeth 52 of the fastener 5 and the locking teeth 41 of the belt 4 are not locked with one another. The cable tie is released.

In accordance with the above design of the cable tie, a plurality of slot bases 3 is fixed on the belt 4 and the part of the belt 4 between the two adjacent slot bases 3 passes the objects A, as shown in FIG. 5.

Figure 6:
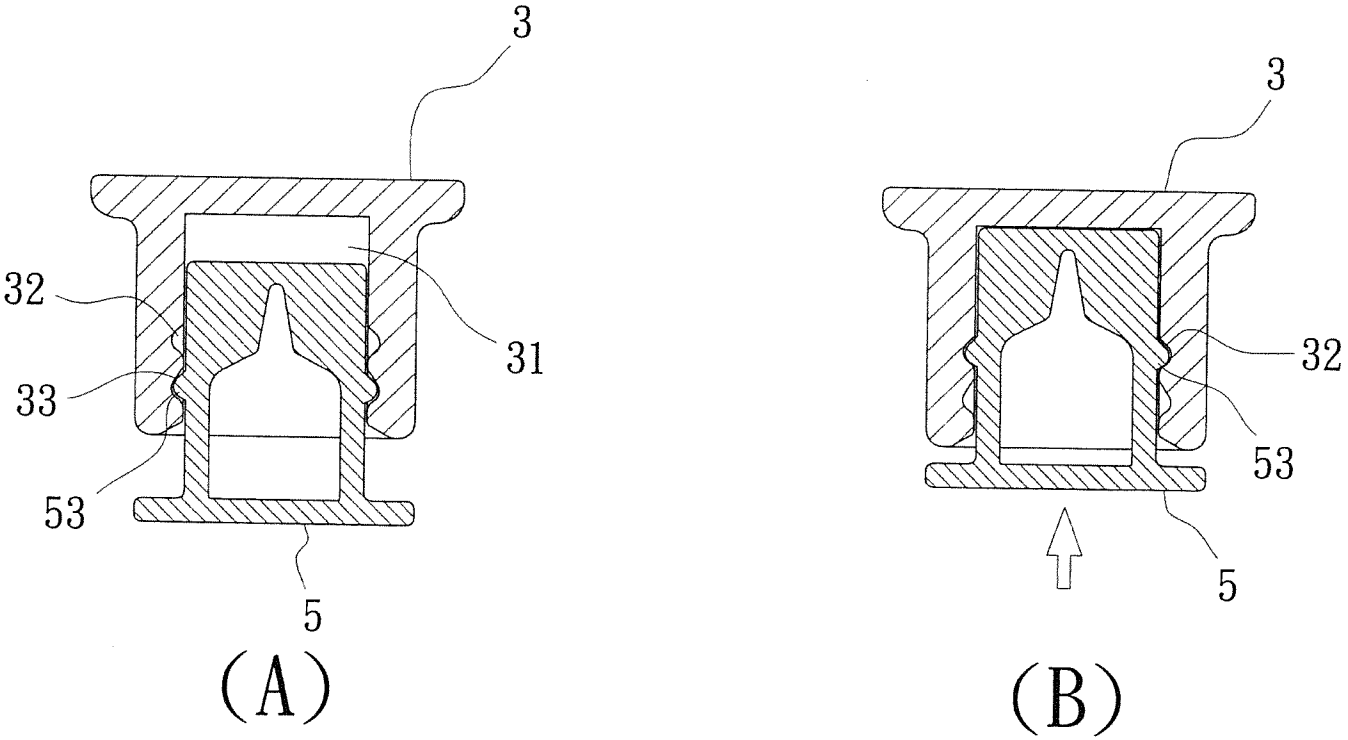
FIG. 6A is a schematic drawing showing the embodiment in FIG. 4 being released according to the present invention.
FIG. 6B is a partial cross sectional view of the embodiment in FIG. 4 in a locked state according to the present invention.

Moreover, refer to FIG. 4, FIG. 6A and FIG. 6B, the slot base 3 further includes a locking slot part 32 and a releasing slot part 33 adjacent to each other while the fastener 5 is disposed with a clamping part 53. When the clamping part 53 of the fastener 5 is locked with the releasing slot part 33, the fastener 5 is on the large hole end of the insertion hole 31 of the slot base 3. Now the projecting teeth 52 of the fastener 5 are not engaged with the locking teeth 41 of the belt 4. While pushing the fastener 5 to make the fastener 5 move to the small hole end of the insertion hole 31 of the slot base 3, the clamping part 53 of the fastener 5 is locked with the locking slot part 32 and the projecting teeth 52 of the fastener 5 are engaged with the locking teeth 41 of the belt 4, in a locked state. Thus the belt 4 is tightened and secured. By the clamping part 53 of the fastener 5 mounted in the locking slot part 32 or the releasing slot part 33, the belt 4 is locked by or released from the fastener 5.

In the FIG. 4, FIG. 6A and FIG. 6B, the adjacent locking slot part 32 and the releasing slot part 33 are arranged at each of two corresponding inner surfaces of the insertion hole 31 of the slot base 3. The clamping part 53 is arranged at each of two side walls of the fastener 5.

Figure 7:
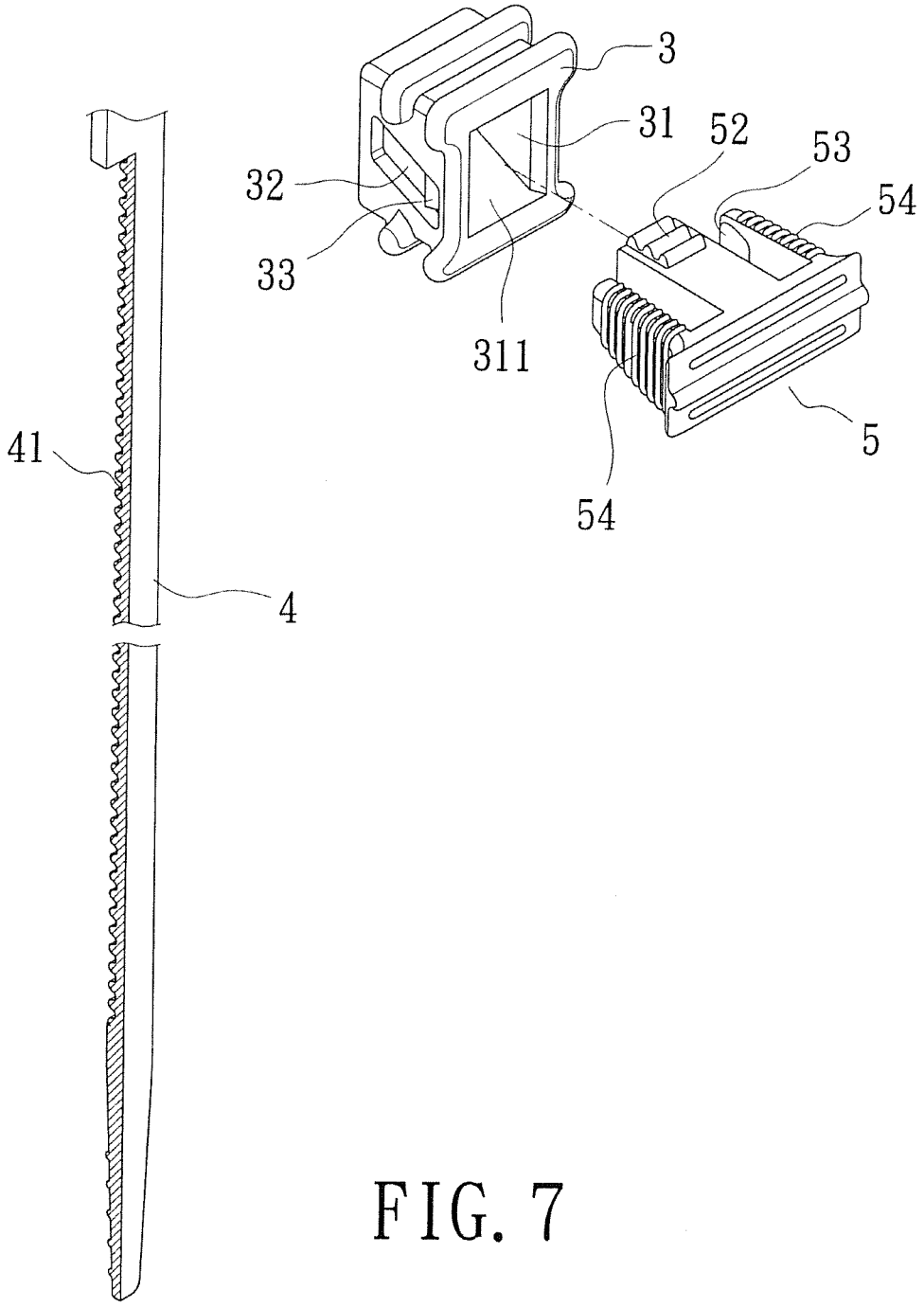
FIG. 7 is an explosive view of another embodiment according to the present invention.
Figure 8:
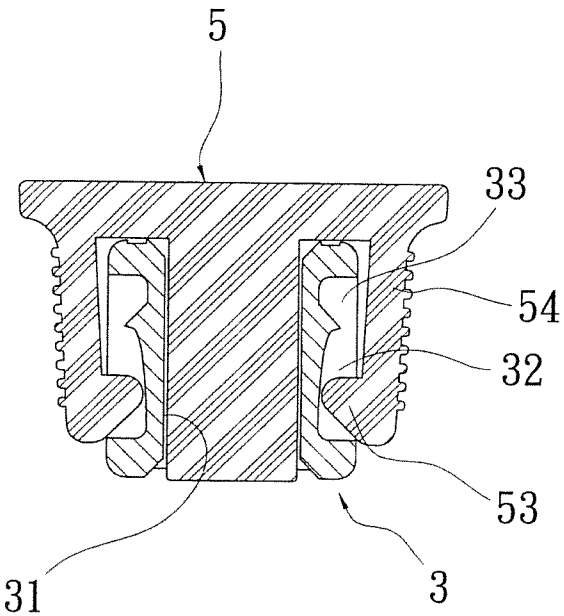
FIG. 8A is a partial cross sectional view of the embodiment in FIG. 7 being released according to the present invention.
FIG. 8B is a partial cross sectional view of the embodiment in FIG. 7 in a locked state according to the present invention.
Figure 8:
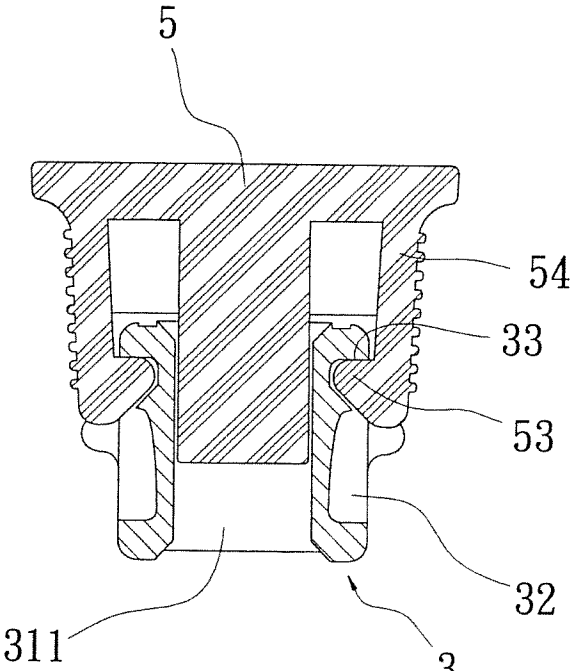

Refer to FIG. 7, FIG. 8A and FIG. 8B, in this embodiment, the adjacent locking slot part 32 and the releasing slot part 33 are arranged at each of two outer surfaces correspondingly of the slot base 3. An arm 54 is extending from each of two sides of the fastener 5 and the clamping part 53 is on the rear end of the arm 54. The clamping part 53 is locked with the locking slot part 32 or the releasing slot part 33 of the slot base 3.

Back to FIG. 6A and FIG. 6B, a central part of the fastener 5 is hollow so that there is a certain space allowing the two sides of the fastener to have elastic deformation. This helps the clamping part 53 of the fastener 5 to be mounted into or removed from the locking slot part 32 or the releasing slot part 33 smoothly.

Figure 9:
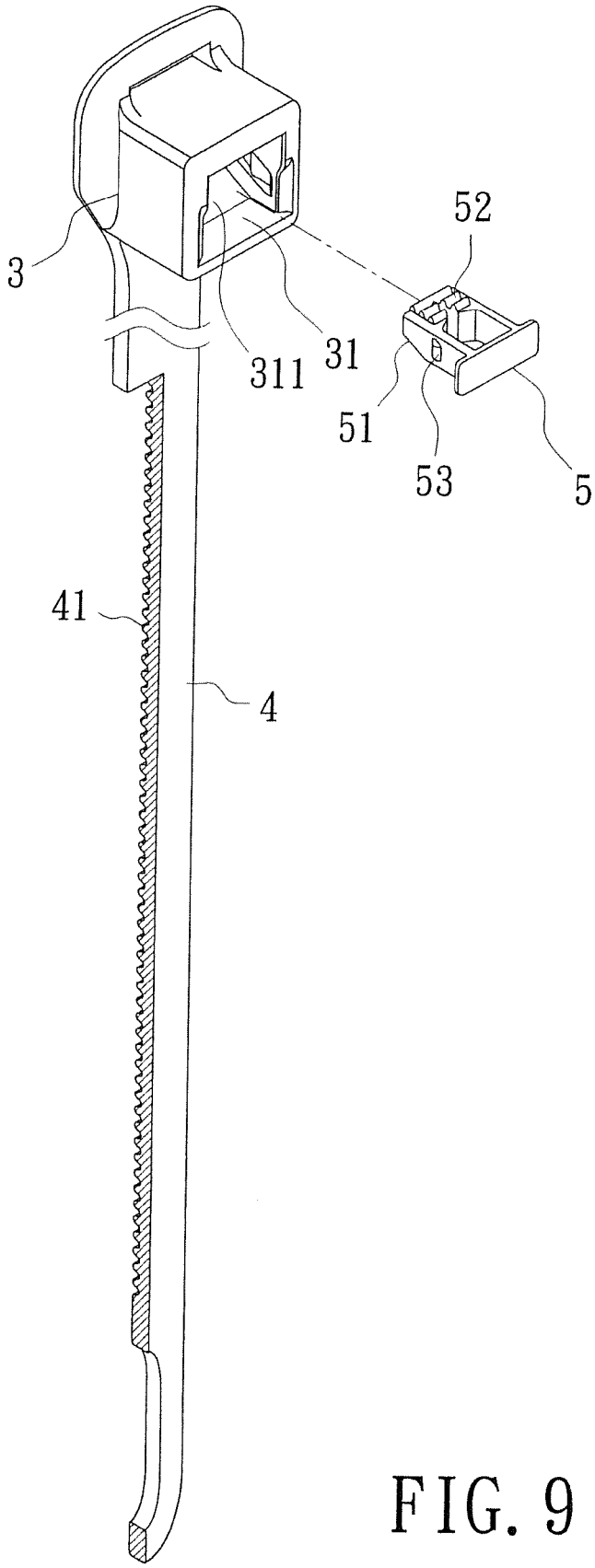
FIG. 9 is an explosive view of a further embodiment in which a slot base and a belt are integrated according to the present invention.
Figure 10:
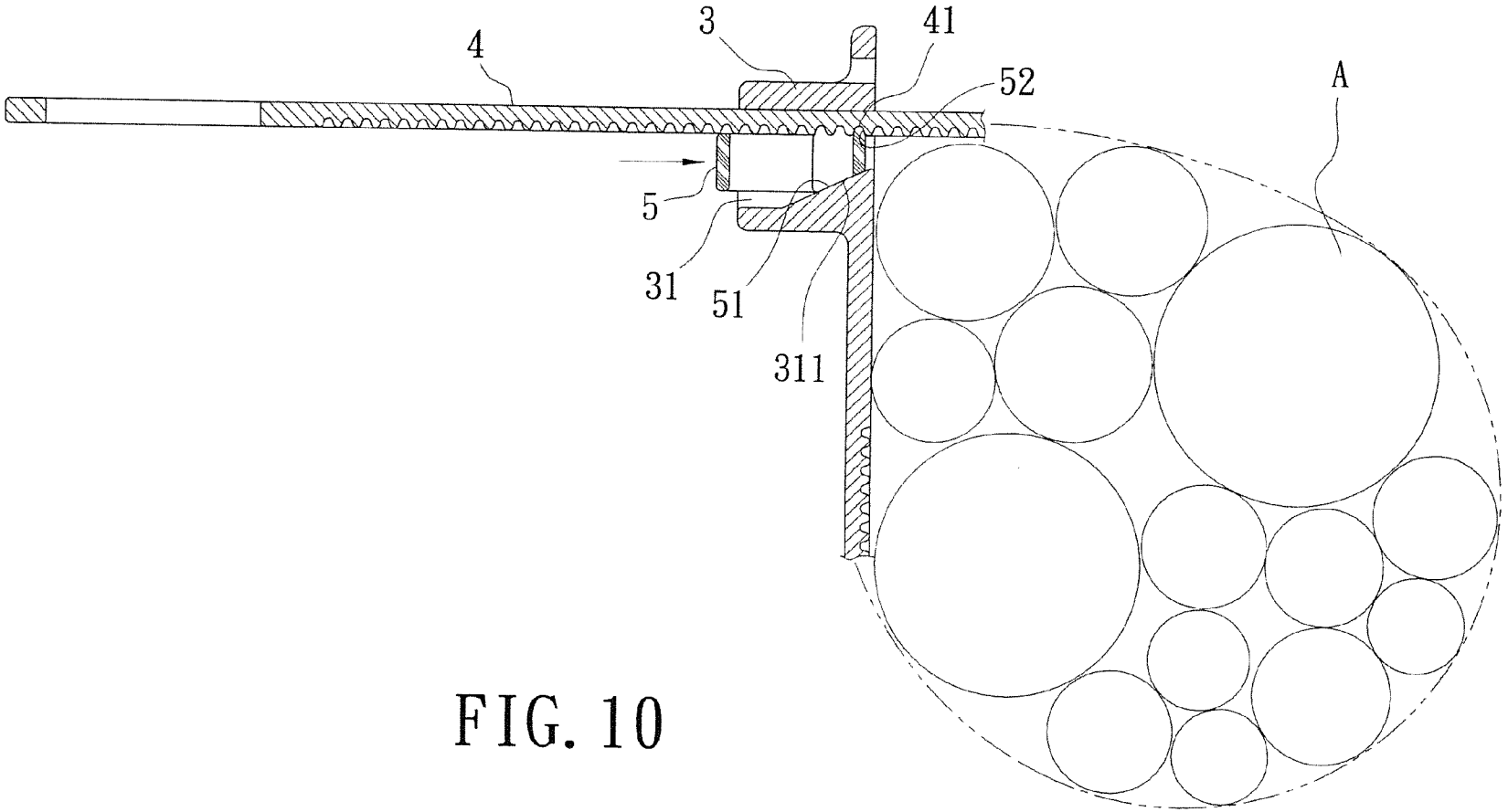
FIG. 10 is a schematic drawing showing the embodiment in FIG. 9 that holds objects according to the present invention.

Refer to FIG. 9, in this embodiment, the slot base 3 and the belt 4 are connected to each other. Refer to FIG. 10, after binding objects A, the belt 4 is then inserted through the insertion hole 31 of the slot base 3. Then the fastener 5 is mounted into the insertion hole 31 and the belt 4 that loops the objects A is locked and tightened by the projecting teeth 52 of the fastener 5 engaged with the locking teeth 41 of the belt 4.

Figure 11:
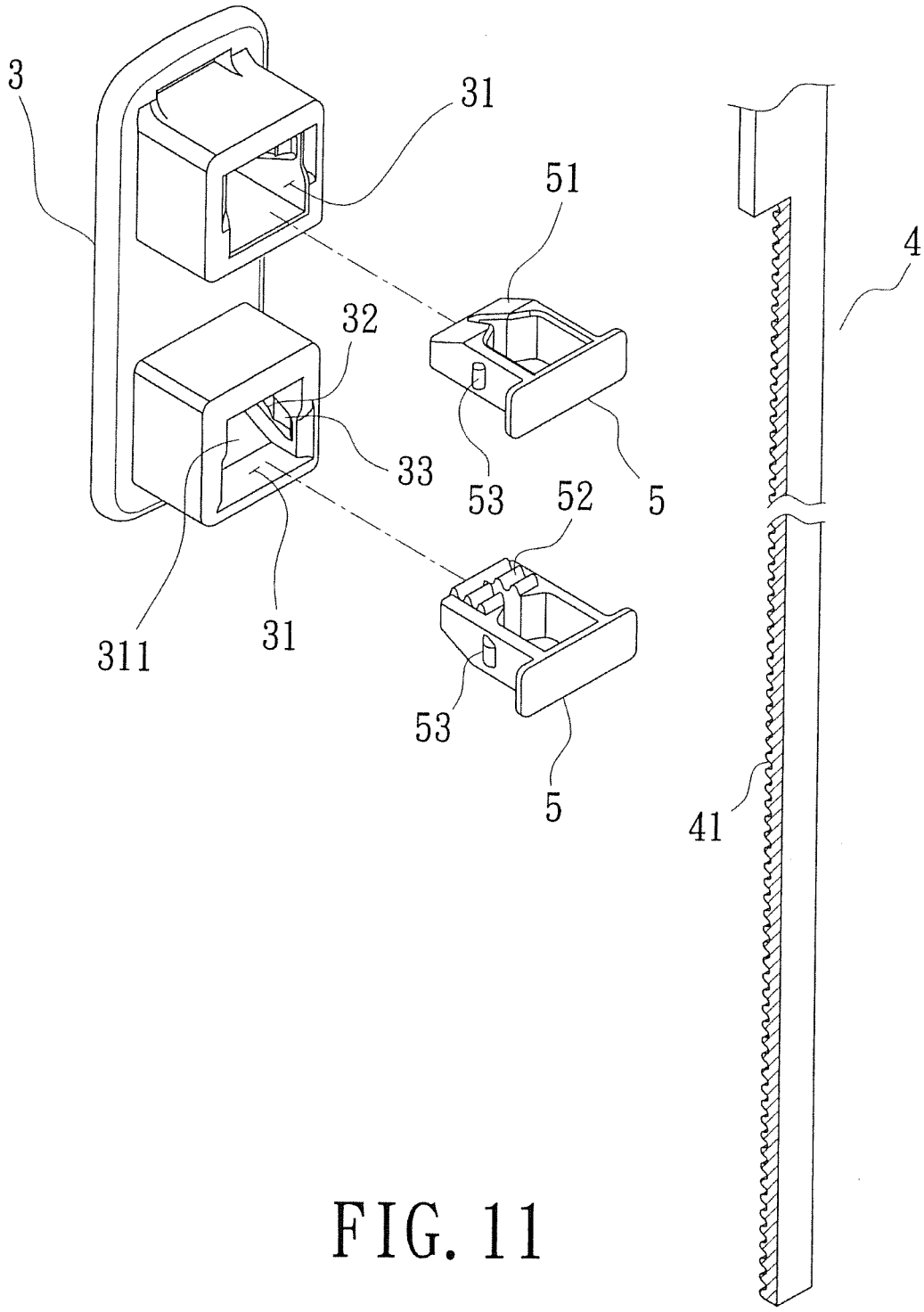
FIG. 11 is an explosive view of a further embodiment according to the present invention.

Refer to FIG. 11, a slot base 3 of this embodiment is further arranged with the other insertion hole 31 so that the slot base 3 includes two insertion holes 31 arranged correspondingly. At least one of the two insertion holes 31 is arranged with a slanted surface 311. Each of the insertion holes 31 has a corresponding fastener 5. A locking slot part 32 and a releasing slot part 33 are disposed on two corresponding surfaces of the insertions hole 31 while a clamping part 53 is arranged at each of two side walls of the fastener 5.

Figure 12:
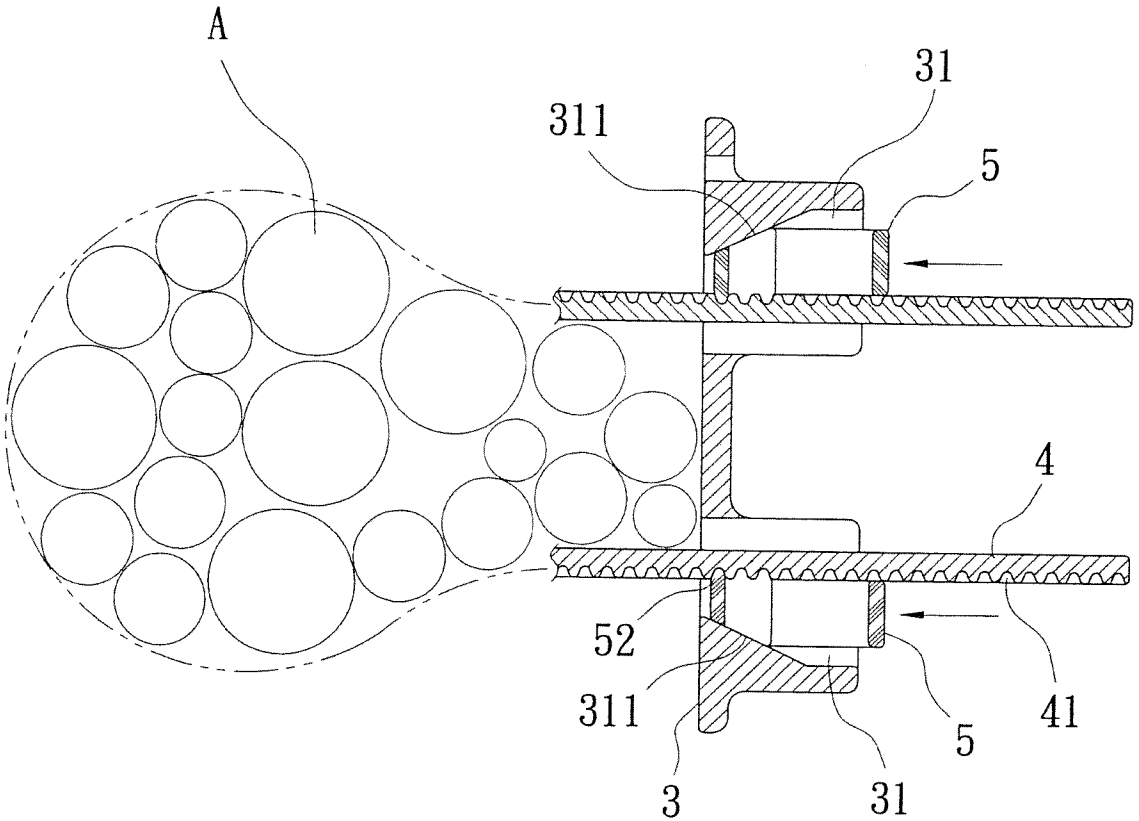
FIG. 12 is a schematic drawing showing the embodiment in FIG. 11 that holds objects according to the present invention.

Refer to FIG. 12, in this embodiment, one end of the belt 4 is passed through one of the insertion holes 31 and then the fastener 5 is mounted into this insertion hole 31 to lock the belt 4. The other end of the belt 4 is inserted through the other insertion hole 31 to be secured by the other fastener 5. Objects A are bound within a looped space formed by the belt 4 passed through the two insertion holes 31.

Figure 13:
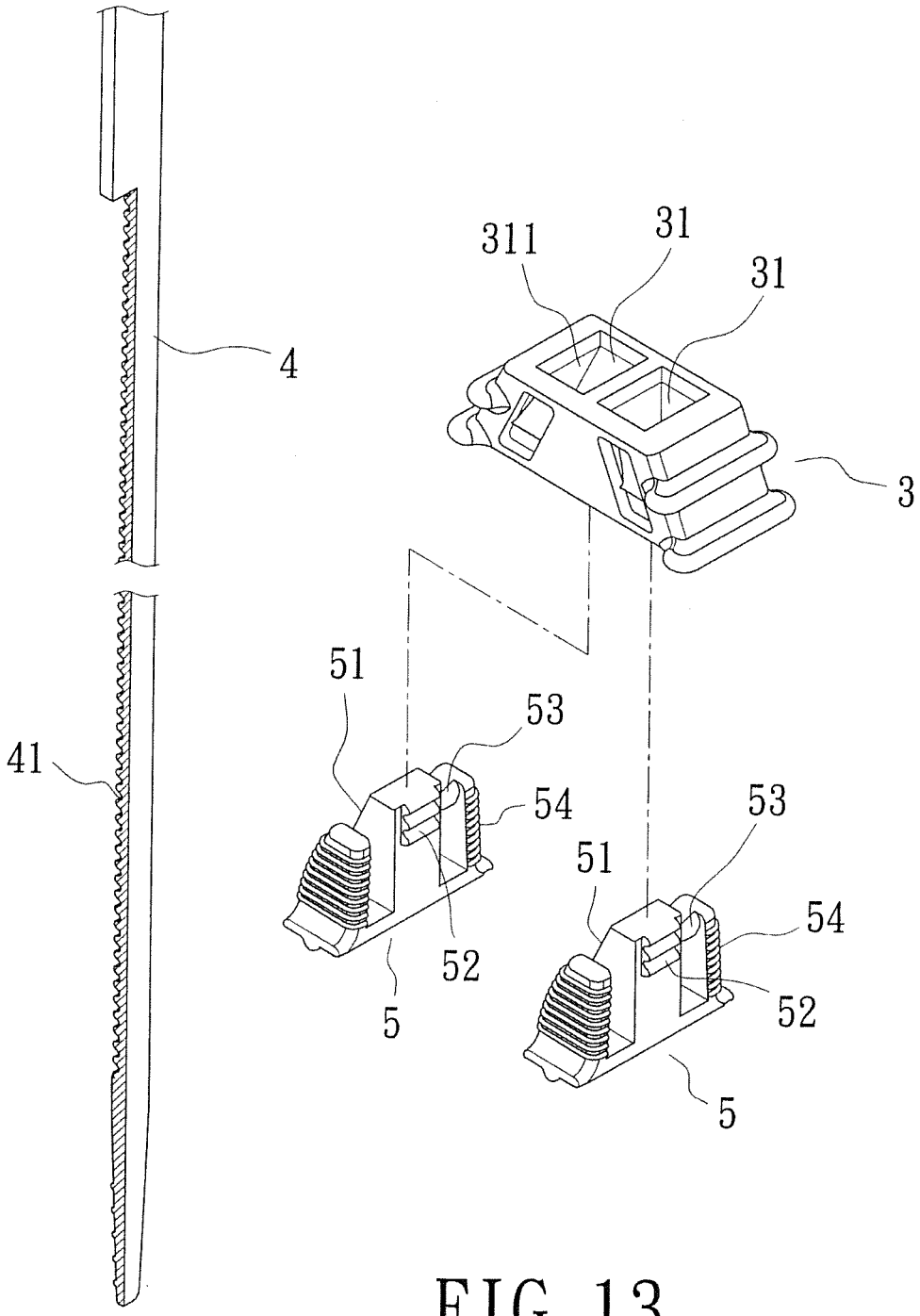
FIG. 13 is an explosive view of a further embodiment according to the present invention.

Refer to FIG. 13, a further embodiment is revealed. A slot base 3 of this embodiment is arranged with two insertion holes 31, each having a corresponding fastener 5. A locking slot part 32 and a releasing slot part 33 are disposed on two corresponding outer surfaces of each insertions hole 31. As to the fastener 5, an arm 54 is extending from each of two sides of the fastener 5 and a clamping part 53 is disposed on a rear end of the arm 54. The clamping part 53 is locked with the locking slot part 32 or the releasing slot part 33 of the slot base 3.

Figure 14:
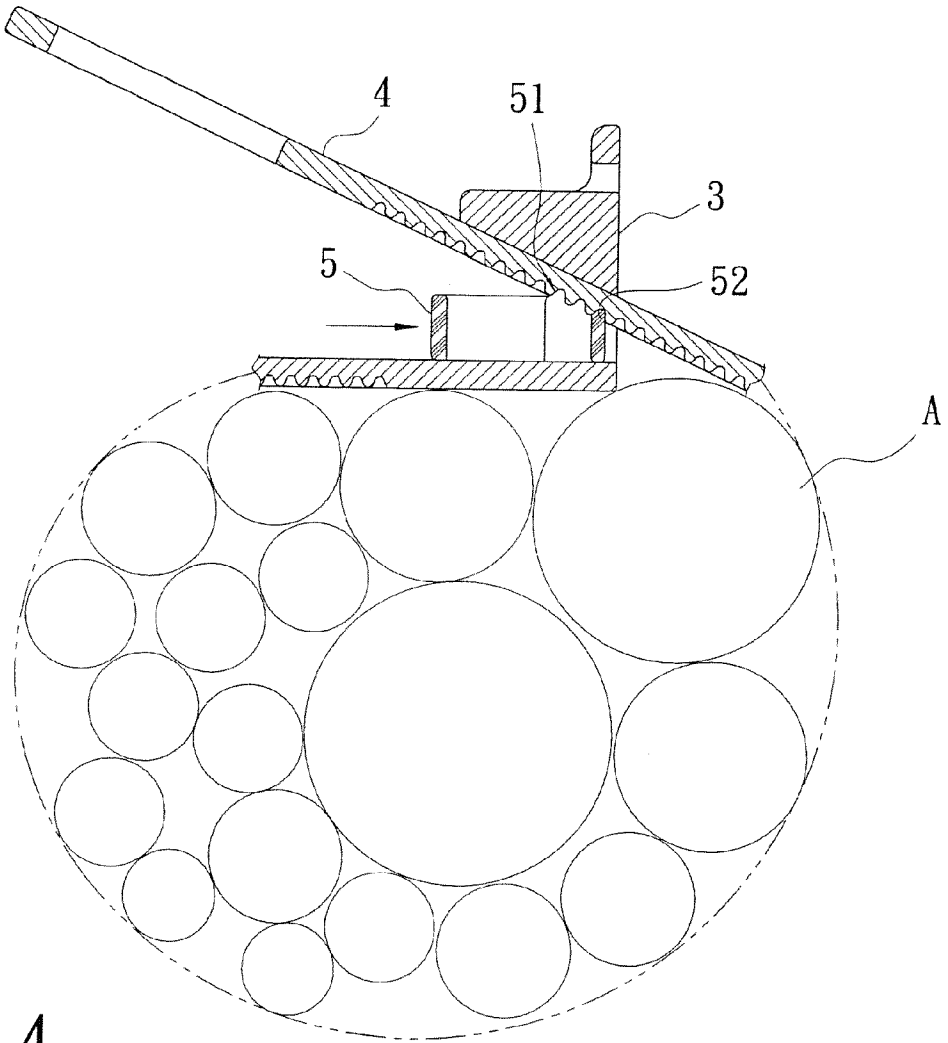
FIG. 14 is a schematic drawing showing a further embodiment in which projecting teeth of a fastener are disposed on a slanted surface for holding objects according to the present invention.

Refer to FIG. 14, in this embodiment, the projecting teeth 52 of the fastener 5 are disposed on the slanted surface 51. In the embodiment shown in FIG. 4 and FIG. 5, the projecting teeth 52 of the fastener 5 are arranged at another surface opposite to the slanted surface 51.

Additional advantages and modifications will readily occur to those skilled in the art. Therefore, the invention in its broader, aspects is not limited to the specific details, and representative devices shown and described herein. Accordingly, various modifications may be made without departing from the spirit or scope of the general inventive concept as defined by the appended claims and their equivalent.

What is claimed is:

1. A cable tie comprising:

a slot base having at least one insertion hole; the insertion hole having at least one slanted surface, the slot base including locking and releasing slot parts partitioned by a protrusion formed therebetween;

a belt with a plurality of locking teeth arranged on a surface at one side thereof; and at least one fastener displaceably mounted in the insertion hole of the slot base; the fastener including a slanted surface corresponding to the slanted surface of the insertion hole, and a plurality of projecting teeth corresponding to the locking teeth of the belt, the fastener including at least one clamping part defining a rounded m the locking and releasing slot parts of the slot base and slidably disengage therefrom across the protrusion.

2. The device as claimed in claim 1, wherein the locking slot part and a releasing slot part, are offset from each other along a direction transverse to the projecting teeth of the fastener.

3. The device as claimed in claim 2, wherein the locking slot part and the releasing slot part are disposed on two corresponding inner surfaces of the insertion hole of the slot base, and the clamping part is arranged at each of two sides of the fastener.

4. The device as claimed in claim 3, wherein a central part of the fastener is hollow to define a space accommodating two sides of the fastener during elastic deformation thereof.

5. The device as claimed in claim 2, wherein the locking slot part and the releasing slot part are disposed on two corresponding outer surfaces of the insertion hole of the slot base, and the clamping part is arranged at a rear end of an arm extending from each of two sides of the fastener.

6. The device as claimed in claim 1, wherein the slot base and the belt are connected to each other.

7. The device as claimed in claim 6, wherein the locking slot part and a releasing slot part, are offset from each other along a direction transverse to the projecting teeth of the fastener.

8. The device as claimed in claim 7, wherein the locking slot part and the releasing slot part are disposed on two corresponding inner surfaces of the insertion hole of the slot base, and the clamping part is arranged at each of two sides of the fastener.

9. The device as claimed in claim 8, wherein a central part of the fastener is hollow to define a space accommodating two sides of the fastener during elastic deformation thereof.

10. The device as claimed in claim 7, wherein the locking slot part and the releasing slot part are disposed on two corresponding outer surfaces of the insertion hole of the slot base, and the clamping part is arranged at a rear end of an arm extending from each of two sides of the fastener.

* * * * *